US005778328A

United States Patent [19]

Trsar et al.

[11] Patent Number: 5,778,328

[45] Date of Patent: Jul. 7, 1998

[54] ENGINE ANALYZER WITH SINGLE-HEAD IGNITION SCOPE

[75] Inventors: Dale A. Trsar, Mt. Prospect; Richard H. Shepherd, McHenry; Yosuf M. Taraki, Evanston; Mark H. Petersen, Mundelein; Tyrone J. Moritz, Morton Grove, all of Ill.

[73] Assignee: Snap-on Technologies, Inc., Lincolnshire, Ill.

[21] Appl. No.: 630,382

[22] Filed: Apr. 10, 1996

[51] Int. Cl.[6] ..... F02P 17/12

[52] U.S. Cl. ..... 701/29; 364/551.01; 73/116; 324/379

[58] Field of Search ..... 364/551.01, 424.034, 364/424.038; 73/116, 117.2, 117.3; 324/378, 379; 701/29, 33

[56] References Cited

U.S. PATENT DOCUMENTS

| | | | |
|---|---|---|---|
| 4,476,531 | 10/1984 | Marino et al. | 364/431.01 |
| 4,812,996 | 3/1989 | Stubbs | 364/487 |
| 4,980,845 | 12/1990 | Govekar | 364/550 |
| 5,160,892 | 11/1992 | Makhija et al. | 324/379 |
| 5,218,302 | 6/1993 | Loewe et al. | 324/380 |
| 5,250,935 | 10/1993 | Jonker et al. | 345/134 |
| 5,387,870 | 2/1995 | Knapp et al. | 324/379 |
| 5,397,981 | 3/1995 | Wiggers | 324/121 R |
| 5,614,828 | 3/1997 | Sims | 324/402 |

*Primary Examiner*—Michael Zanelli

*Attorney, Agent, or Firm*—Emrich & Dithmar

[57] ABSTRACT

An engine analyzer with a digital oscilloscope display includes a processor for controlling the acquisition and display of a high-voltage secondary ignition signal waveform with the use of only a single high-voltage reactive pickup probe, the waveform being displayed with a fixed-time sweep and either auto or signal triggering. The system provides for user selection of the sweep and trigger modes.

9 Claims, 6 Drawing Sheets

ENGINE ANALYZER WITH SINGLE-HEAD IGNITION SCOPE

BACKGROUND OF THE INVENTION

1. Field of the Invention

The invention relates to engine analyzers for electronically diagnosing and analyzing the performance of internal combustion engines and, in particular, relates to such analyzers which display waveform information on an oscilloscope display screen.

2. Description of the Prior Art

Prior engine analyzers have been provided with screen displays in the nature of oscilloscopes. Such analyzers have a plurality of signal pickup leads adapted to be connected to selected points on a multi-cylinder internal combustion engine for acquiring input analog signals therefrom. The input waveform signals may be digitized and stored in memory and displayed on the oscilloscope screen. One of the engine waveforms which is commonly displayed on an engine analyzer scope is the secondary ignition voltage which appears at the secondary winding of an ignition coil and is applied to the spark plugs for the several cylinders. For the purpose of acquiring the secondary waveform signal, the engine analyzer is typically provided with a high-voltage, reactive-type pickup lead. The analyzer is also typically provided with a number of other pickup leads for acquiring other types of signals from the engine.

In prior analyzers, in order to display an ignition waveform, such as a secondary signal waveform, the scope must also be provided with a separate sync signal, which is acquired with a separate lead, which may be a no. 1 cylinder pickup lead adapted to be coupled to the spark plug wire for the no. 1 signal in the firing order. Thus, this lead permits the analyzer to keep track of which cylinder is firing, once the firing order of the engine is known. Thus, at least two leads must be connected to the engine in order to acquire and display a secondary ignition signal.

The horizontal scale (also called sweep) of an oscilloscope screen represents time. Broadly speaking, in an engine analyzer there are two types of sweeps: engine sweeps and fixed-time sweeps. Engine sweeps display waveforms for either a single cylinder ignition or for a complete engine cycle (the time between consecutive firings of the same cylinder), and is typically used to display waveforms related to cylinder ignition events, such as primary (from the primary winding of the coil) and secondary ignition signals. For engine sweeps, the analyzer includes means for identifying the cylinder firings. Engine sweeps may be of any of three different types: cylinder, parade and raster, all of which are well-known. Since engine sweeps begin and end with the firing of a cylinder, the time represented by an engine sweep varies with engine speed. Fixed-time sweeps, e.g., 10 ms, 100 ms, etc., display a fixed period of time across the width of the screen display, and are typically used to display waveforms other than primary and secondary waveforms.

An oscilloscope screen essentially displays snapshots of discrete portions of the waveform representing an electrical signal. The mechanism which determines the starting point for each snapshot is referred to as triggering. Prior digital analyzer scopes have supported three types of triggering, viz. auto, signal and cylinder triggering. Auto triggering occurs randomly on a periodic basis, the repeat rate being determined by the selected horizontal sweep time scale. Signal triggering occurs when the displayed signal crosses a threshold level. Cylinder triggering occurs when a selected cylinder of the engine under test is fired. This latter trigger mode is used to examine signals from the electrical system of the engine while synchronizing with a selected cylinder. Thus, cylinder triggering normally requires that the no. 1 pickup lead be connected to the engine in addition to the primary or secondary signal pickup.

It would sometimes be desirable for an operator to be able to make a quick check of an engine ignition system by simply viewing the secondary signal for a specific cylinder. However, in order to do this in prior analyzers, it is necessary to connect at least both the secondary pickup lead and the sync or no. 1 cylinder pickup lead.

It is known in prior engine analyzers to operate the analyzer in a standard lab scope mode, which is typically used for analyzing waveforms other than primary and secondary waveforms, and utilizes a fixed-time sweep. Accordingly, such analyzers must use either auto or signal triggering when operating in the lab scope mode. For acquiring signals to display in lab scope mode, the analyzer is typically provided with one or more general purpose voltage pickup leads. While the signals on such leads can be displayed in the lab scope mode without the need for a separate sync input, these general purpose voltage pickup leads cannot be used for acquiring and displaying secondary ignition signals, since they utilize conductive pickup probes and are not suitable for acquiring voltages in the kilovolt range.

SUMMARY OF THE INVENTION

It is a general object of the invention to provide an improved apparatus for analyzing waveforms of multi-cylinder internal combustion engines, which avoids the disadvantages of prior apparatuses while affording additional structural and operating advantages.

An important feature of the invention is the provision of an engine analyzer with a oscilloscope display screen which can acquire and display a secondary ignition signal with the use of only a single pickup lead.

This and other features of the invention are attained by providing a system for analyzing the operation of a multi-cylinder internal combustion engine having an ignition coil with a high-voltage secondary winding, the apparatus comprising: waveform acquisition means including a high-voltage ignition pickup lead adapted to be coupled to the engine for receiving a secondary signal analog input waveform therefrom and generating waveform data representative of such analog waveform, an oscilloscope display device having a display screen for displaying waveform data, processing means coupled to the display device and operable under stored program control for controlling display of the waveform data with fixed-time sweeps, the processing means including trigger means establishing a threshold signal level and responsive to only the signal on the ignition pickup lead and the threshold level and the fixed sweep time of the display device for controlling the triggering of the display device.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
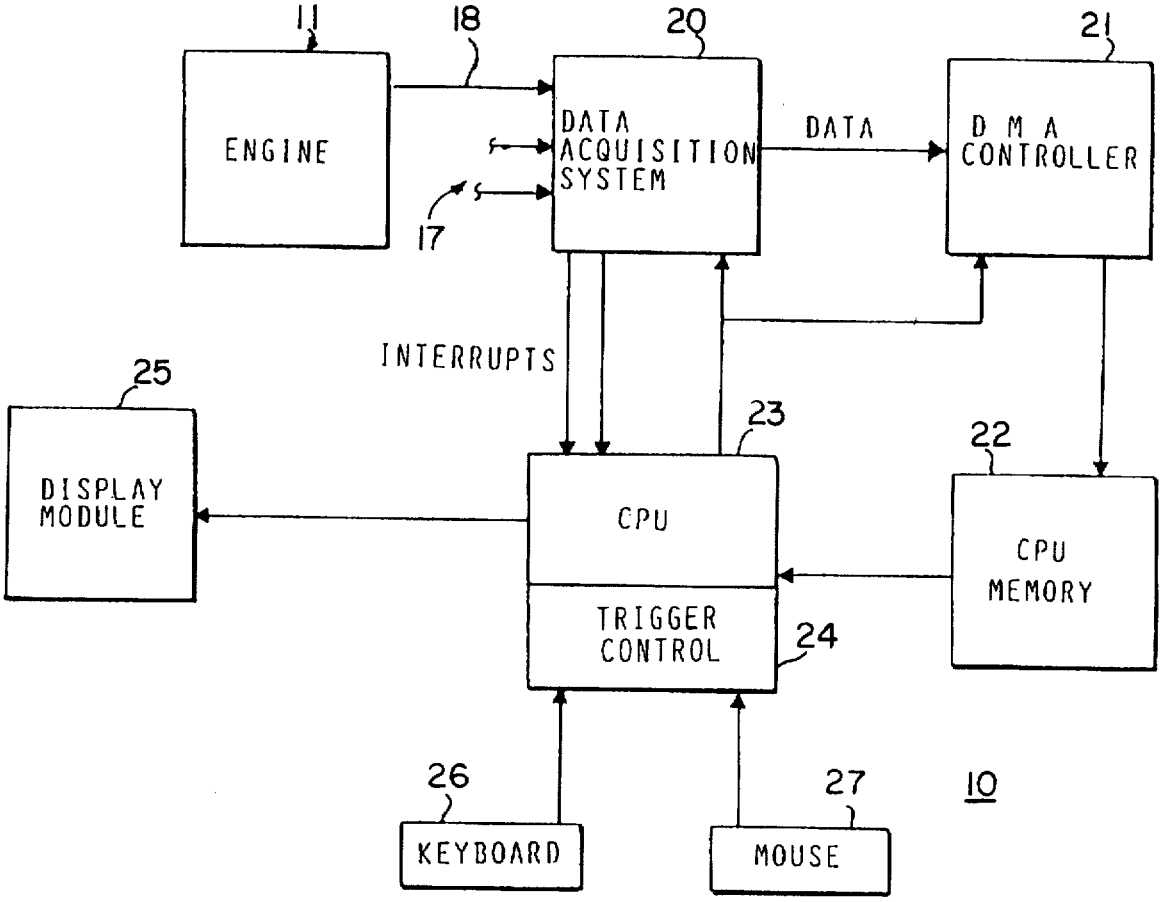
FIG. 1 is a functional block diagram of an engine analyzer system incorporating a digital oscilloscope display in accordance with the present invention.

Referring to FIG. 1, there is illustrated an engine analyzer, generally designated by the numeral 10, in accordance with the present invention. The engine analyzer 10 is adapted for analyzing the operation of an associated multi-cylinder internal combustion engine 11 by, inter alia, monitoring analog waveform signals generated by the engine 11.

Figure 2:
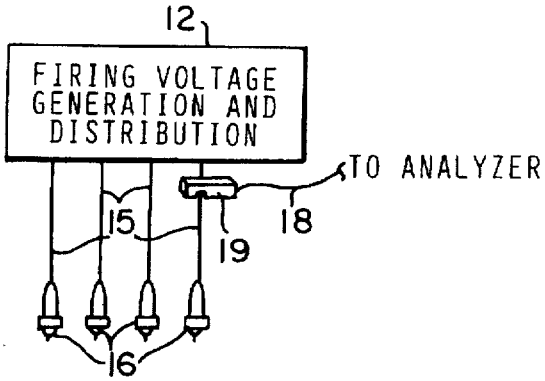
FIG. 2 is a diagrammatic illustration of a portion of an internal combustion engine ignition system with a secondary pickup lead of the engine analyzer of FIG. 1 coupled to a cylinder spark plug wire.

Referring to FIG. 2, the engine 11 has an ignition system which includes a firing voltage generation and distribution system 12, which may have a coil with a high-voltage secondary winding (not shown) which is coupled through a distributor for sequentially applying the secondary winding voltage to the wires 15 of spark plugs 16 for the several cylinders. Four such spark plugs are shown, simply for purposes of illustration, in FIG. 2. Alternatively, the system 12 may have plural coils with high-voltage secondary windings respectively coupled to cylinder wires.

In order to acquire input signals from the engine 11, the analyzer 10 is provided with the plurality of signal pickup leads 17 which are adapted for connection to selected points in the engine 11. Among the pickup leads is a secondary lead 18 which is provided with a reactive pickup probe 19, such as a capacitive or inductive pickup, adapted for non-conductive acquisition of the high-voltage secondary signal from the engine 11. The pickup leads 17 also include a primary pickup lead for acquiring a signal from the primary winding of the coil 12, as well as a no. 1 cylinder probe for coupling to the spark plug wire 15 for the no. 1 cylinder, all in a known manner. While only three pickup leads have been shown in FIG. 1, simply for purposes of illustration, it will be appreciated that typically other auxiliary leads are provided for acquiring other signals, including non-ignition related signals, which auxiliary leads may include general-purpose voltage pickup probes.

The signal pickup leads 17 and 18 are coupled to a data acquisition system 20, which may include suitable signal conditioning circuits and trigger detection circuits in a known manner, and also includes an analog-digital converter (ADC) for digitizing the analog input signals to generate digital waveform data in a known manner. The waveform data is applied to a DMA (direct memory access) controller 21 which, in turn, controls the storage of the waveform data in a memory 22.

The analyzer 10 is provided with a suitable central processing unit (CPU) 23, which may be in the form of a microprocessor, which is coupled to the waveform data acquisition system 20, the DMA controller 21 and the memory 22. The CPU 23 receives interrupts from the waveform data acquisition system 20 and controls the sampling of the analog waveform by the ADC and also controls the operation of the DMA controller 21 for controlling the writing of waveform data to the memory 22. The CPU 23 includes a trigger control function 24 and controls transfer of stored waveform data from the memory 22 to a display module 25, and also controls the various operational modes of the display module 25. In this regard, the display module 25 is preferably a color oscilloscope display and is operable with various sweeps and with various types of triggering, the latter being controlled by the trigger control function 24. User selection of these and other parameters is effected through an appropriate user interface, which may include a keyboard 26 and/or a mouse 27 which are coupled to the CPU 23.

The display module 25 is provided with a plurality of different fixed-time sweeps and the usual cylinder, parade and raster engine sweeps, as described above in connection with prior engine analyzers. In addition, the display module 20 is preferably provided with 5 ms engine sweeps, which are similar to the standard engine sweeps discussed-above, except that only the first 5 ms of each cylinder waveform is plotted. There are 5 ms engine sweeps corresponding to each of the standard engine sweeps, viz., cylinder 5 ms, parade 5 ms and raster 5 ms.

The engine analyzer 10 supports all of the three standard types of triggering for digital display scopes in engine analyzers, viz. cylinder triggering, automatic triggering and signal triggering. Engine sweeps and 5 ms engine sweeps use cylinder triggering. Fixed-times sweeps use either automatic or signal triggering, as is standard in prior art digital engine analyzers.

Figure 3:
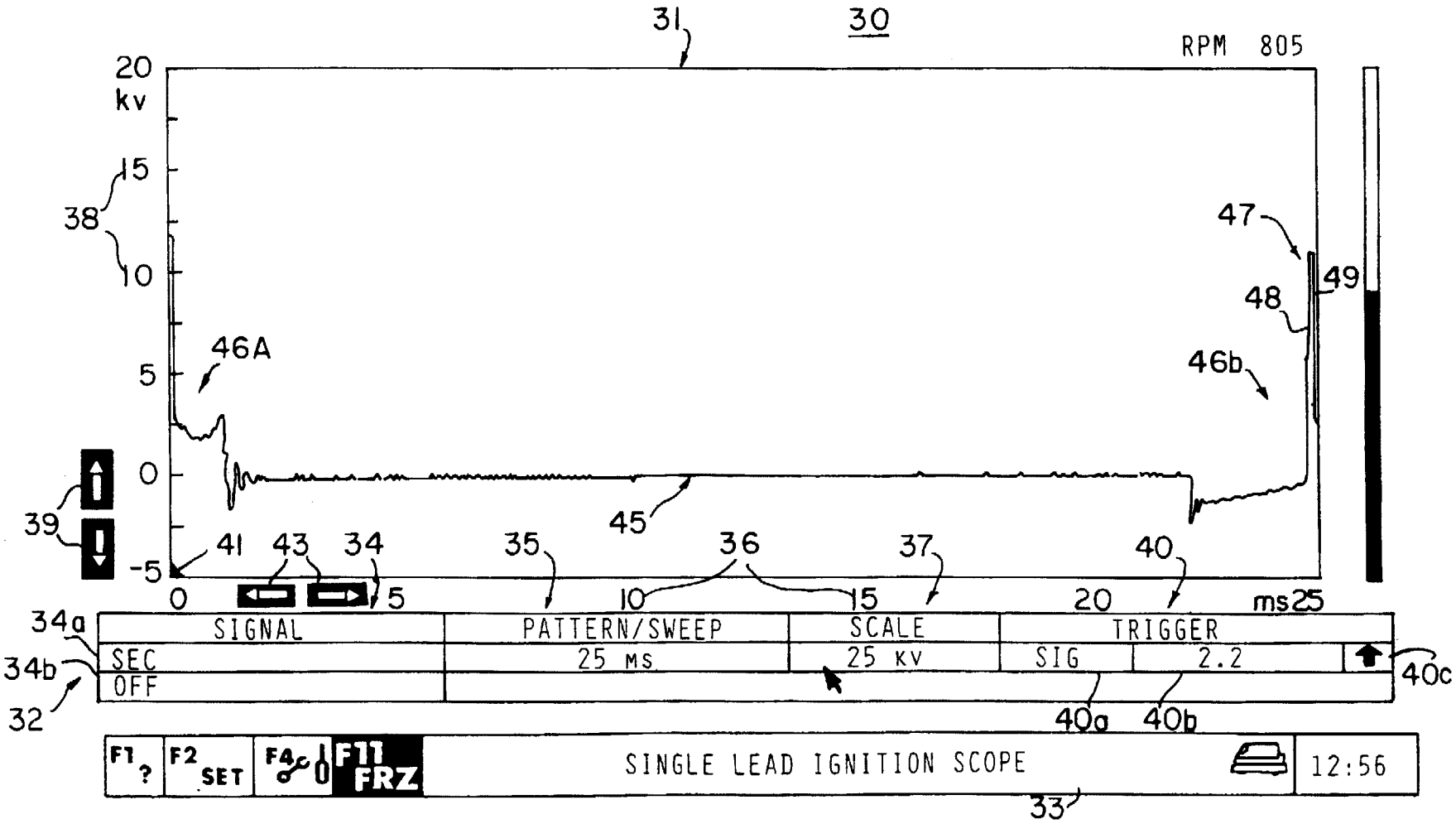
FIGS. 3 and 4 are screen displays obtainable with the engine analyzer system of FIG. 1.

Referring now to FIG. 3, there is illustrated a screen display 30, which is one of a number of screen displays available with the engine analyzer 10 and which will be useful for explaining the significant aspects of the invention. While the display module 25 is operable in either single or dual-trace modes, the screen display 30 is set up in a single-trace display mode, so that it has a single rectangular waveform plot area 31 for displaying a waveform along a horizontal axis or trace. Displayed below the waveform plot area 31 is a control panel area 32, including a number of icons and indicators in the nature of rectangular boxes in which text or other indicia may be displayed, the boxes being arranged in horizontal rows. In the lowermost row is a scope mode indicator 33, which indicates the selected scope mode. In this case the indicated mode is "Single Lead Ignition Scope", which is used for displaying a secondary ignition signal when it is acquired by the use of only the secondary lead 18 without a separate trigger input.

The control panel area 32 also includes a Signal icon 34, which includes boxes **34*a* and 34*b* for respectively indicating the signals displayed in the two traces of the scope when it is operating in dual-trace mode. In each of these boxes, the user can select from among a plurality of different signal options, with different options respectively corresponding to different ones of the signal pickup leads 17, 18. In this case, the signal displayed on the first (and only) trace is the signal appearing on the secondary pickup lead 18. For the box 34*b***, one of the available options is OFF. When this option is selected, as in FIG. 3, the second trace is OFF so that the scope is operating in single-trace mode.

There is also a Pattern/Sweep icon 35 which indicates the selected sweep, in this case a 25 ms fixed-time sweep. In the single lead Ignition Scope mode, only fixed-time sweeps can be used, since the no. 1 pickup lead is not connected to provide the necessary information for engine sweeps. Time indicia 36 indicating the sweep time scale are displayed across the bottom of the waveform plot area 31 in 5 ms increments.

There is also provide a Scale icon 37 which indicates the scale of the plot area 31 along the vertical axis. In this case a 25 kv scale has been selected. Accordingly, scale indicia 38 are arranged in 5 kv increments along the left-hand side of the waveform plot area 31.

The control panel area 32 also includes a Trigger icon 40 which includes a box **40*a* for indicating the type of triggering which has been selected. In this case, only auto and signal triggering are available. When signal triggering is selected, as in FIG. 3, the icon 40 also includes a box 40*b* which indicates the threshold voltage at which triggering will occur, in this case 2.2 kv. The icon 40 also includes a box 40*c*** which indicates by an arrow, the slope of the input signal with which it must cross the threshold voltage in order to effect triggering, in this case a rising slope.

In will be appreciated that, normally, each of the icons 34, 35, 37 and 40 includes vertically arranged boxes respectively corresponding to the two traces of the scope. However, in this case, since a single-trace mode has been selected, the boxes corresponding to the second trace are eliminated for the icons 35, 37 and 40.

As can be seen in FIG. 3, the screen display 30 includes other icons, indicators and other types of indicia which are not pertinent to the present invention and, therefore, are not discussed herein.

The secondary waveform signal 45 is plotted in the waveform plot area 31, two cycles or firings of the selected cylinder being indicated, at 46A and 46B. The secondary waveform for each cylinder firing or ignition has a distinctive shape, including a high-amplitude spike 48 of very short rise and fall times at the beginning of the cylinder power stroke, caused by the buildup of voltage across the spark plug just prior to its firing. The trigger threshold voltage is set so that it will detect this spike to trigger the display. By default, the trigger point of the waveform display is positioned at the left-hand edge of the waveform plot area 31. This trigger point is indicated by a trigger cursor 41, which is a triangular icon, only half of which is illustrated in FIG. 3, since the apex of the triangle signifies the trigger point. However, the position of the trigger point on the screen can be selectively shifted to coincide with any of the time indicia 36, as will be explained below.

Figure 4:
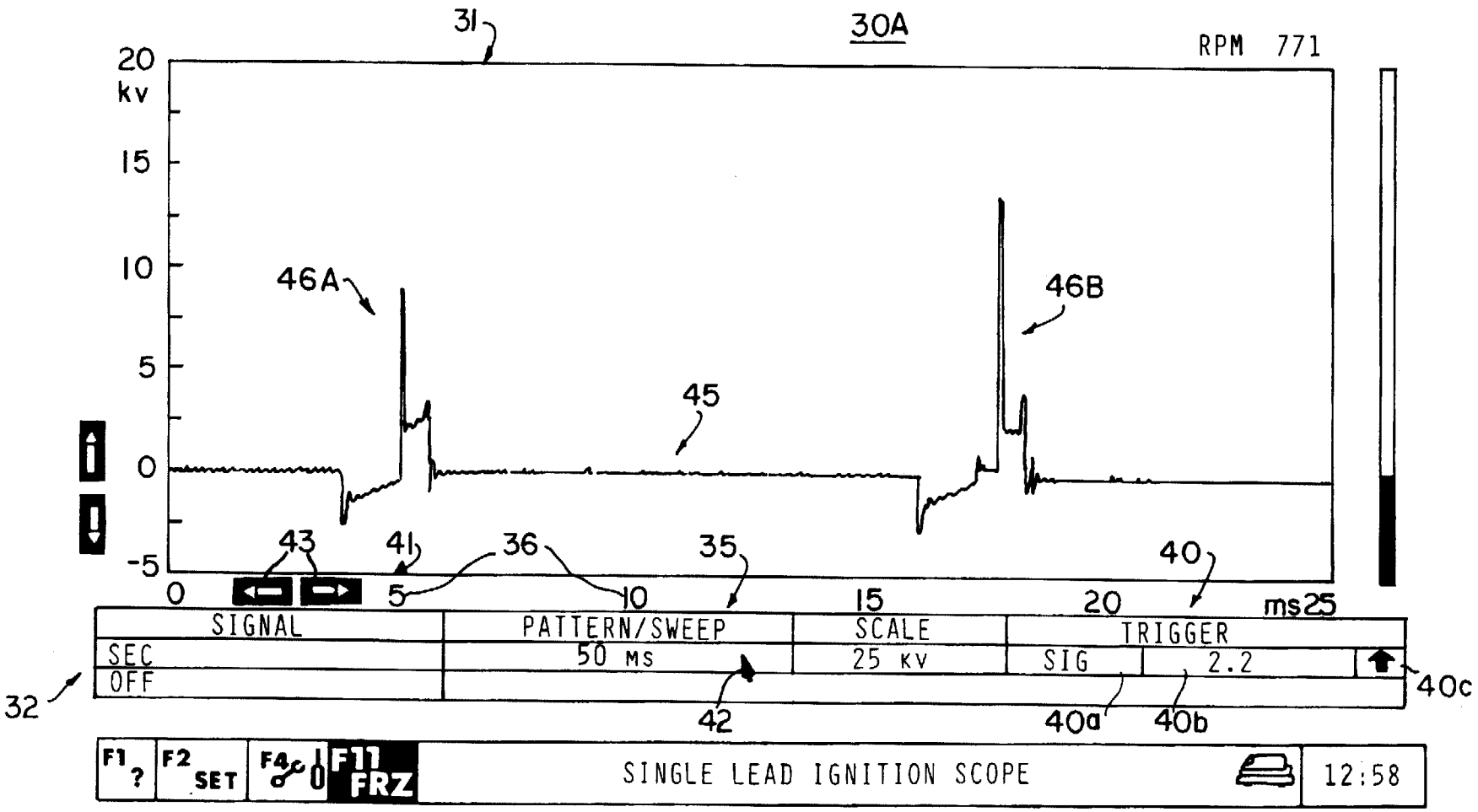

In FIG. 3, the engine speed is such that the cylinder firings appear, respectively, adjacent to the left and right edges of the plot area 31, which makes it difficult to interpret them. Referring to FIG. 4, there is illustrated a screen display 30A, which is substantially identical to the screen display 30 of FIG. 3, except that in this case a 50 ms fixed-time sweep has been selected, as indicated by the Pattern/Sweep icon 35. Thus, the cylinder ignitions 46A and 46B are closer together and, in order to move them both toward the center of the screen, the location of the trigger point on the screen has been shifted to the 10 ms point, as indicated by the trigger cursor 41.

In general, each of the several icons in the control panel area 32 represents a switch, which can be operated by the user by means of either the keyboard 26 or the mouse 27. For the icons 34, 35, 37 and 40, the icon box with respect to which a selection is to be made is first activated, activation being indicated on the screen by emphasizing the icon. Emphasis is indicated by a thickened or brightened border around the box. Thus, in FIG. 3, the box for the Scale icon 37 is emphasized, while in FIG. 4 the box for the Pattern/Sweep icon 35 is emphasized. With the keyboard 26, the arrow keys are used to shift the activation and emphasis to the appropriate box and then the "+" and "–" keys are used to index forwardly or rearwardly through the options within the emphasized box. In order to activate a box not already activated with the mouse 27, the mouse is clicked once on the box. Then, each subsequent click of the mouse button on the emphasized icon will index the switch one option forward. Alternatively, the mouse button can be held down, locking the mouse cursor (arrowhead 42) within the emphasized box, and the mouse is then moved up and down to scroll the available options through the emphasized box. In this manner, the user can selectively change the trigger mode by use of the icon box **40*a* and, when signal trigger is selected, can selectively change the trigger threshold voltage by use of the icon box 40*b* and can change the slope direction of the trigger point by use of the icon box 40*c***.

Adjustment of the trigger offset, i.e., the position of the trigger point and the trigger cursor 41 on the screen, is by a slightly different technique. With the keyboard 21, the user activates the Pattern/Sweep box 35 and then uses the "page up" and "page down" keys to shift the trigger cursor 41 to the right or to the left, with each operation of the key shifting the cursor one time-scale division, in this case 10 ms. By use of the mouse 27, the user places the mouse cursor 42 on the appropriate one of the arrow icons 43 and then clicks the mouse button, with each click jumping the trigger cursor 41 one scale division (10 ms in this case) either right or left, depending upon which arrow is selected.

While the above-described switch selection techniques are used in the preferred embodiment, it will be appreciated that the engine analyzer 10 can be programmed so that switch selections can be made with other combinations of operations of the keyboard 26 and/or the mouse 27.

Figure 5:
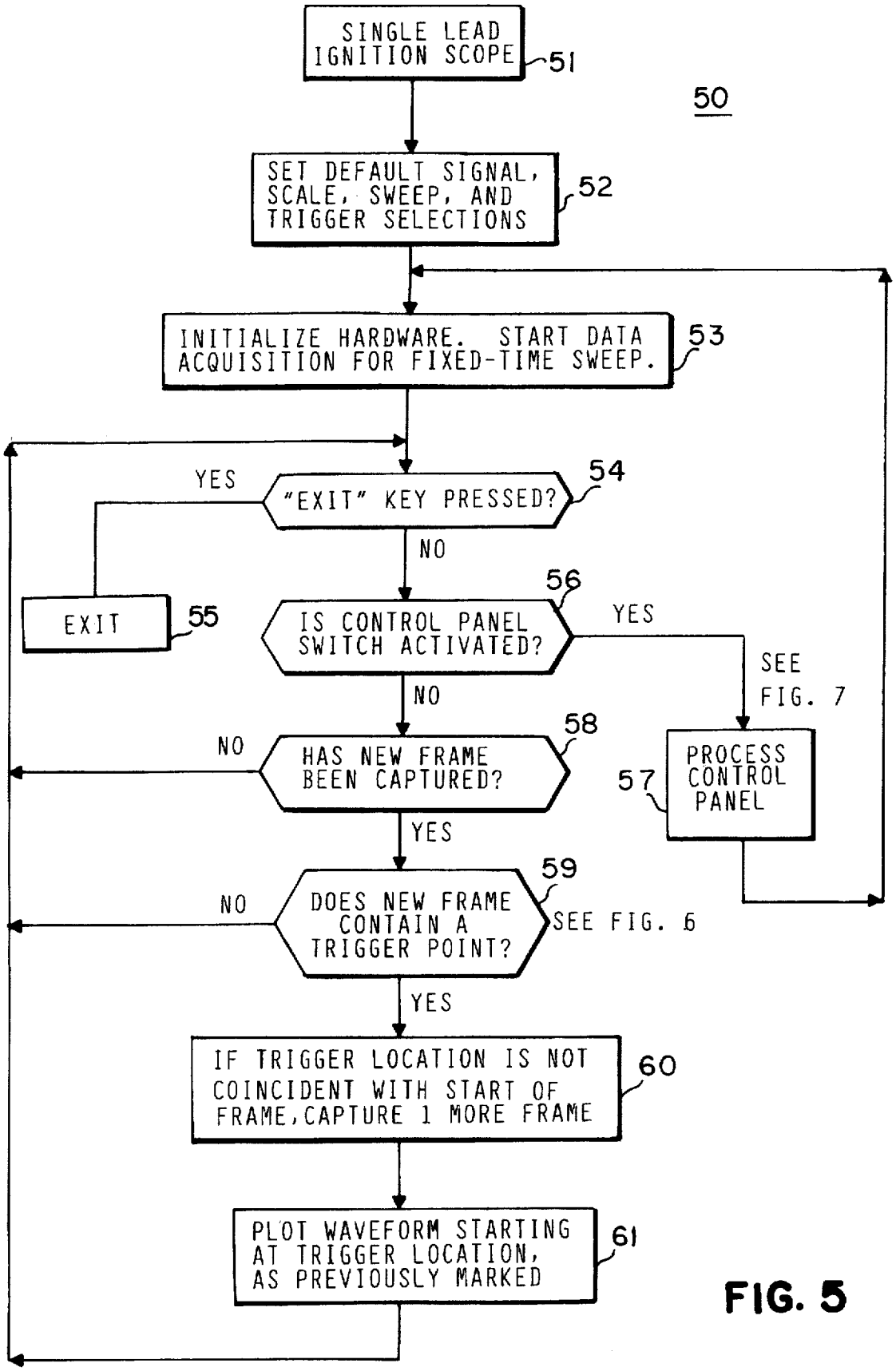
FIGS. 5–7 are flow chart diagrams of a software program of the engine analyzer of FIG. 1 for controlling the acquisition and display of an ignition waveform with the use of a single pickup lead.
Figure 6:
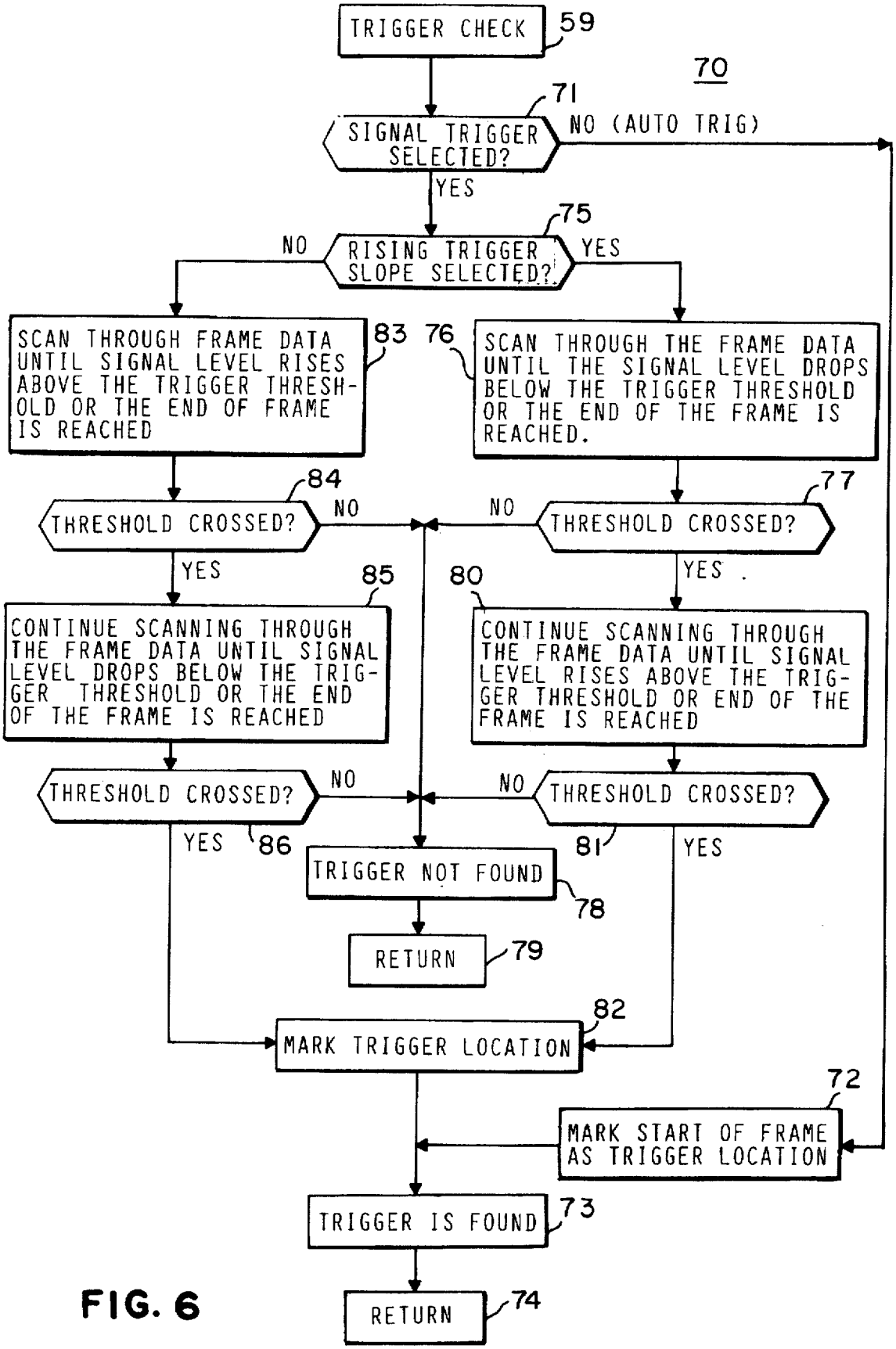
Figure 7:
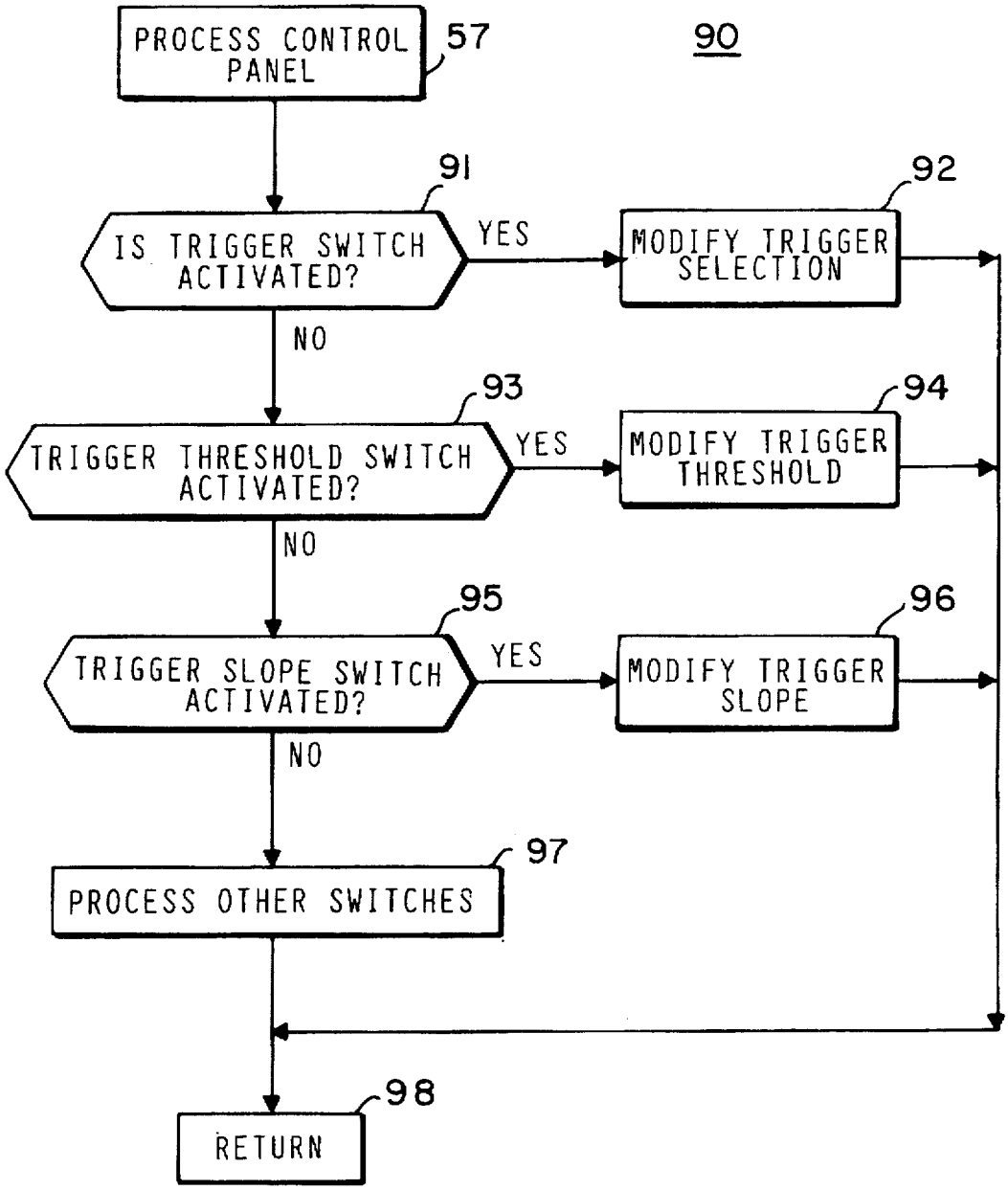

Referring now to FIGS. 5–7, there are shown flow diagrams illustrating the management of the single lead ignition scope mode and the triggering selection routine in that mode. The main routine, designated 50 in FIG. 5, is entered at 51, and the program first at 52 sets the default Signal, Sweep, Scale and Trigger icon selections. Then, at 53, the program initializes the hardware and starts data acquisition for a fixed-time sweep, which is the only type of sweep which can be utilized in this mode. Next, at 54 the program asks if an EXIT key has been pressed. If it has, the routine is exited at 55 and, if not, the program checks at 56 to see if a control panel switch has been activated. If it has, the program processes the control panel at 57 by means of a subroutine which will be described below in connection with FIG. 7, and then returns to block 53. If no control panel switch has been activated at 56, the program asks at 58 if a new frame of waveform data has been captured, a frame representing one screen-width of data in the case of a fixed-time sweep. If it has not, the program returns to decision 54. If a frame of data has been captured, the program then asks at 59 if that frame contains a trigger point, making this determination by means of a subroutine which will be explained below in connection with FIG. 6. If there is no trigger point, the program again returns to decision 54. If there is, the program at 60 checks to see if the trigger location is coincident with the start of a frame and, if not, captures one more frame, and then at 61 plots the waveform, starting at the trigger location as previously marked (in the subroutine of FIG. 6), and then returns to decision 54 to repeat the loop.

In order to determine if a frame of data contains a trigger point, the program utilizes the subroutine 70 illustrated in FIG. 6, which is entered at 59 from the routine 50 of FIG. 5. This Trigger Check routine first checks at 71 to see if signal triggering has been selected in the icon box 40*a*. If it has not, this means that auto triggering is selected, since this is the only other type of triggering available in this mode, so the program then at 72 marks the start of the frame as the trigger location and then indicates, at 73, that a trigger has been found and returns at 74 to the decision 59 in the routine of FIG. 5.

If, at 71, a signal trigger has been selected, the program next checks at 75 to see if a rising trigger slope has been selected in the icon box 40*c*. If it has, the program at 76 scans through the frame data until the signal level drops below the trigger threshold or the end of a frame is reached. Then, at 77 it asks if the threshold has been crossed. If it has not, the program indicates at 78 that a trigger has not been found and returns at 79 to the routine of FIG. 5. If the threshold was crossed at 77, the program at 80 continues scanning through the frame data until the signal level rises above the trigger threshold or the end of a frame is reached, then, at 81, again asks if the threshold has been crossed. If not, the program again signals that a trigger has not been found at 78 and then returns. If the threshold has been crossed the program marks this trigger location at 82, then drops to block 73 to indicate that a trigger has been found before returning.

If, at 75, a rising trigger slope was not selected, this means that a falling trigger slope is selected and the program at 83 scans through the frame data until the signal level rises above the trigger threshold or the end of a frame is reached. Then, at 84, the program asks if the threshold has been crossed. If not, the program moves to block 78 and, if so, it continues scanning through the frame data at 85 until the signal level drops below the trigger threshold or the end of the frame is reached. Then, at 86, the program again checks to see if the threshold has been crossed. If not, it moves to block 78 and, if so, it marks the trigger location at 82 and proceeds as before.

Referring now to FIG. 7, there is illustrated a Process Control Panel subroutine 90, which is called at 57 from the main routine 50 of FIG. 5. This subroutine first checks at 91 to see if the switch which was activated is the switch for the Trigger icon 40*a* and, if so, modifies the trigger selection at 92 and then returns at 98 to the routine of FIG. 5. If the Trigger switch was not activated, the program next checks at 93 to see of it was the trigger threshold switch associated with the icon box 40*b*. If yes, the trigger threshold is modified accordingly at 94 before returning and if not, the program next checks at 95 to see if it was the trigger slope selection switch for the icon 40*c*. If so, the slope selection is modified at 96 and, if not, the program processes the other switches in the control panel area 32 and then returns.

From the foregoing, it can be seen that there has been provide an improved engine analyzer with a digital oscilloscope display, which can display a secondary ignition waveform with only a single pickup lead, utilizing auto or signal triggering, and which also provides for user selection of the trigger mode and trigger parameters.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. Apparatus for analyzing the operation of a multi-cylinder internal combustion engine having an ignition coil with a high-voltage secondary winding, said apparatus comprising:

waveform acquisition means including a high-voltage ignition pickup lead adapted to be coupled to the engine for receiving a secondary signal analog input waveform therefrom and generating waveform data representative of such analog waveform, an oscilloscope display device having a display screen for displaying waveform data, processing means coupled to said display device and operable under stored program control for controlling display of the waveform data with fixed-time sweeps, said processing means including trigger means, said trigger means establishing a threshold signal level and being responsive to only the signal on said ignition pickup lead and the threshold level and the fixed sweep time of the display device for controlling the triggering of said display device.

2. The apparatus of claim 1, wherein said ignition pickup lead includes a reactive pickup probe.

3. The apparatus of claim 1, and further comprising: user interface means coupled to said processing means for user entry of data and process control selections.

4. The apparatus of claim 3, wherein said user interface includes a keyboard.

5. The apparatus of claim 3, wherein said user interface includes a mouse.

6. The apparatus of claim 3, wherein said user interface includes switch means for selecting a fixed-time sweep for the display screen.

7. The apparatus of claim 6, wherein said user interface includes switch means for user selection between an auto trigger mode based on the fixed-time sweep selected and a signal triggering mode based on the displayed waveform crossing the threshold level in a predetermined direction.

8. The apparatus of claim 7, wherein said switch means includes means for selecting the threshold level and the direction.

9. The apparatus of claim 1, wherein said waveform acquisition means includes means for digitizing the waveform data, and further comprising memory means for storing digitized waveform data.

* * * * *

UNITED STATES PATENT AND TRADEMARK OFFICE

CERTIFICATE OF CORRECTION

PATENT NO. : 5,778,328

DATED : July 7, 1998

INVENTOR(S) : Dale A. Trsar et al.

It is certified that error appears in the above-identified patent and that said Letters Patent is hereby corrected as shown below:

Title page, item

[54] "ENGINE ANALYZER WITH SINGLE-HEAD IGNITION SCOPE" should be

--ENGINE ANALYZER WITH SINGLE-LEAD IGNITION SCOPE--.

Signed and Sealed this

Seventeenth Day of November, 1998

*Attest:*

*Attesting Officer*

BRUCE LEHMAN

*Commissioner of Patents and Trademarks*